US012595149B2

(12) United States Patent
Damiani et al.

(10) Patent No.: US 12,595,149 B2
(45) Date of Patent: Apr. 7, 2026

(54) MACHINE AND METHOD FOR PRODUCING PACKAGES OF FOLDED OR INTERFOLDED LAMINAR PRODUCTS MADE OF PAPER, IN PARTICULAR PACKAGES OF NAPKINS, TISSUES, TOWELS, OR SIMILAR PRODUCTS

(71) Applicant: KÖRBER TISSUE FOLD S.R.L., Porcari (IT)

(72) Inventors: Daniele Damiani, Coreglia Antelminelli (IT); Daniele Dettori, Capannori (IT)

(73) Assignee: KÖRBER TISSUE FOLD S.R.L., Porcari (IT)

( * ) Notice: Subject to any disclaimer, the term of this patent is extended or adjusted under 35 U.S.C. 154(b) by 283 days.

(21) Appl. No.: 18/288,014

(22) PCT Filed: May 12, 2022

(86) PCT No.: PCT/IB2022/054419
§ 371 (c)(1),
(2) Date: Oct. 23, 2023

(87) PCT Pub. No.: WO2022/238949
PCT Pub. Date: Nov. 17, 2022

(65) Prior Publication Data

US 2024/0199363 A1 Jun. 20, 2024

(30) Foreign Application Priority Data

May 14, 2021 (IT) ..... 102021000012539

(51) Int. Cl.
*B65H 31/10* (2006.01)
*B65H 31/30* (2006.01)
(Continued)

(52) U.S. Cl.
CPC ..... *B65H 31/10* (2013.01); *B65H 31/3054* (2013.01); *B65H 31/32* (2013.01);
(Continued)

(58) Field of Classification Search
CPC .... B65H 31/10; B65H 31/3054; B65H 31/32; B65H 45/24; B65H 2404/2693; B65H 2404/692; B65H 2701/1924
See application file for complete search history.

(56) References Cited

U.S. PATENT DOCUMENTS 3,490,762 A 1/1970 Nystrand
4,721,295 A * 1/1988 Hathaway ..... B65H 33/02 270/39.02
(Continued)

FOREIGN PATENT DOCUMENTS

EP 1 415 945 A1 5/2004
EP 1 457 444 A2 9/2004
(Continued)

*Primary Examiner* — Jeremy R Severson
(74) *Attorney, Agent, or Firm* — Maschoff Brennan

(57) ABSTRACT

A machine for producing packages of folded or interfolded laminar products made of paper, in particular packages of napkins, tissues, towels, or similar products, comprising a folding or interfolding group, equipped with a first and a second folding or interfolding roll configured to fold or interfold a plurality of sheets of paper, and to obtain a stack of folded or interfolded sheets, according to a predetermined folding or interfolding configuration, which grows in height along a vertical forming direction. The machine comprises, furthermore, a separation group configured to separate a completed stack of folded or interfolded sheets, once that a predetermined height of said stack being formed is reached, from a following stack being formed. A transfer group is, furthermore, provided configured to transfer the completed
(Continued)

stack on a discharge device configured to discharge the completed stack from the machine.

19 Claims, 15 Drawing Sheets

(51) Int. Cl.
*B65H 31/32* (2006.01)
*B65H 45/24* (2006.01)

(52) U.S. Cl.
CPC ..... *B65H 45/24* (2013.01); *B65H 2404/2693* (2013.01); *B65H 2404/692* (2013.01); *B65H 2701/1924* (2013.01)

(56) References Cited

U.S. PATENT DOCUMENTS

| | | | | |
|---|---|---|---|---|
| 4,770,402 | A * | 9/1988 | Couturier ..... | B65H 31/32<br>270/39.02 |
| 6,228,014 | B1 | 5/2001 | De Matteis et al. | |
| 2011/0158782 | A1 | 6/2011 | Walsh et al. | |

FOREIGN PATENT DOCUMENTS

| | | | |
|---|---|---|---|
| EP | 1 520 819 | A1 | 4/2005 |
| EP | 1 520 822 | A2 | 4/2005 |
| EP | 1 640 305 | A1 | 3/2006 |

* cited by examiner

MACHINE AND METHOD FOR PRODUCING PACKAGES OF FOLDED OR INTERFOLDED LAMINAR PRODUCTS MADE OF PAPER, IN PARTICULAR PACKAGES OF NAPKINS, TISSUES, TOWELS, OR SIMILAR PRODUCTS

FIELD OF THE INVENTION

The present invention relates to the paper field and in particular to machines and processes for producing laminar products made of paper, such as packages of napkins, tissues, and similar products.

DESCRIPTION OF THE PRIOR ART

As known, folding and interfolding machines exist equipped with systems for causing the worked sheets of paper to adhere on the surface of rolls, in order to guide them along a predetermined path to carry out the fold according to a determined folding or interfolding configuration.

The systems that carry out the aforementioned adhesion provide mechanical pliers, or alternatively, pneumatic suction systems.

An example of an interfolding machine provided with a folding unit equipped with pliers is described in EP1520819.

An example of a folding unit equipped with folding or interfolding rolls provided with a pneumatic suction system is, instead, described in EP1457444.

The aforementioned folding or interfolding units are, in particular, adapted to fold or interfold the worked sheets, or webs of paper, according to a predetermined folding or interfolding configuration.

Among the possible ways to fold the sheets or webs of paper are known, in particular, the "V", "L" interfolded, with 2 panels, the "Z" interfolded with 3 panels and the "W" interfolded with 4 panels.

In the case of "L" or "V" interfolded, which are obtained with the so-called "single-fold" machines, of the type that is for example described in U.S. Pat. No. 6,228,014, the webs of paper are cut in such a way to form two staggered sequences of sheets that are, then, alternately fed to the folding rolls. In this way, each sheet coming from a first direction is overlapped, for half a sheet, to a portion of the sheet coming from a second direction, and vice versa, at the moment when the fold is carried out.

In the case of "Z", "W", interfolded or also having more panels, obtained by the so-called "multifold" machines of the type that is, for example described in U.S. Pat. No. 3,490,762, a single web of paper is worked and at the folding rolls a sequence of sheets already partly overlapped to each other arrives from a single direction. As described in EP1520822, the overlap between two following sheets is carried out, immediately after the cut, by a transfer roll and a delay roll, which form together a small curve at a previous sheet below which a portion of a following sheet positions.

After a separation step of a stack from a following one, once that a determined height, or number of sheets, of the packages is obtained, a transferring step of the packages follows for carrying out any following treatment and the wrapping. In particular, downstream of the interfolding zone separation members detaching fingers, or hands, separators, etc. are normally provided to carry out the separation of the stack being formed in the packages, as for example described in EP1415945.

The packages are, then, transferred, for example by one, or more formation tables on a discharge device, in particular a chute, or a conveyor belt to be subject to following operations. In particular, in the case of interfolded products, the package exiting the head of the interfolding machine can be directed to a cutting machine to form single packages of desired length and, then, to move them to a cartoner machine, which packs them within suitable disposable boxes, which are directly distributed to the users. With this solution the so-called "facial tissue" products are generally produced.

Alternatively, the product can be distributed in packages or bandaged clips, as in the case of the "hand towels", which can be introduced within fixed distributors having a standard shape. In this case, the package of interfolded product is, generally, at first, pressed and, then, wrapped by a tape covering the same, forming a tubular case. The wrapped log is then cut into single packages or clips that are, then, already wrapped by a corresponding portion of tape.

However, the transferring step on the aforementioned discharge device, which is, normally, carried out by one, or more formation tables, negatively weighs on the productivity velocity of the machines because, at this stage, the components involved have to vertically cover several dozens of cm to be able to carry out the separation of a package from the following stack being formed. In particular, when packages of small height are produced, that means containing a smaller number of sheets, under the same feeding speed of the sheets, the time to transfer the package just formed on the discharge device decreases. In other words, under the same feeding speed of the sheets, the number of packages per minute, or machine cycles, which have to be separated and discharged from the interfolding machine to the units arranged downstream of the same, increases. The increase of the machine cycles per minute implies dynamics more and more high for the formation tables and the separators thus making decrease the quality of the formed packages. Therefore, it is not possible to excessively increase the cycles per minute of the prior art machines which, therefore, have a low productivity.

Furthermore, again mainly due to the stroke that the formation tables have to cover to transfer the completed packages on the discharge device, the aforementioned operation is highly expensive both for the energetic costs and for the wear of the mechanical components which carry out their displacement.

Another drawback of the known solutions is the production rigidity of this type of machines due to the pre-established strokes of the formation tables that are rigidly pre-set to transfer the packages on the discharge device it is not possible to produce packages having different heights.

Other examples of paper converting machines with the above disclosed drawbacks are described in EP1640305 and US2011/158782.

SUMMARY OF THE INVENTION

It is, therefore, an object of the present invention to provide a machine for producing packages of folded or interfolded laminar products made of paper, in particular packages of napkins, tissues, towels, or similar products, that is able to overcome the aforementioned drawbacks of the prior art machines.

It is, in particular, an object of the present invention to provide a machine for producing packages of laminar products having a high productivity and a production velocity higher than the prior art machines.

It is another object of the present invention to provide a machine for producing packages of laminar products that is highly flexible because able to produce packages of different heights.

It is also an object of the present invention to provide a method for producing laminar products in packages having analogous advantages.

These and other objects are achieved by a machine for producing packages of folded or interfolded laminar products made of paper, in particular packages of napkins, tissues, towels, or similar products, said machine comprising:

a folding or interfolding group equipped with a first and a second folding or interfolding roll configured to fold or interfold a plurality of sheets of paper, and to obtain at a forming channel a stack of folded or interfolded sheets according to a predetermined folding or interfolding configuration arranged to grow in height along a forming direction, in particular a vertical forming direction;

a separation group configured to separate a completed stack of folded or interfolded sheets, once that a predetermined height is reached of said stack being formed, from a following stack being formed positioned upstream of said completed stack along said vertical forming direction, said separation group comprising a 30 first and a second separator member arranged to enter into said stack being formed from opposite sides to separate said completed stack from said following stack being formed;

a transfer group configured to transfer said completed stack on a discharge device configured to discharge said completed stack from said machine;

whose main characteristic is that a displacement device is, furthermore, provided operatively connected to the aforementioned discharge device and configured to move the discharge device along a displacement direction towards/from the transfer group.

Other technical characteristics of the present invention and the related embodiments are set out in the dependent claims.

In particular, the first and second separator members can be arranged to support together the completed stack up to a predetermined first height (q1). More in particular, the transfer group can be arranged to move from an position external to the stack to a support position at a height (q1'), slightly higher than the first height (q1), whereby the separation group and the transfer group are arranged to support together, for a short stretch, the stack being formed between the aforementioned height (q1') and the first height (q1). Then, the first and second separator members are arranged to exit the stack whereby, after that the first height (q1) is reached, the transfer group goes on alone to support the stack being formed assisting its growth.

In particular, the transfer group can be arranged to support the stack being formed between the first height (q1) and a second height (q2) advantageously less than the first height (q1). More in particular, at the second height (q2) the transfer group can be arranged to position the completed stack on the discharge device.

Advantageously, the displacement device can be configured to move the discharge device along the aforementioned displacement direction during a working cycle, i.e. during the formation of the stack of folded or interfolded sheets.

In particular, the displacement device can be configured to move the discharge device from a predetermined third height (q3) less than the predetermined second height (q2) up to the predetermined second height (q2) at which the transfer group is arranged to discharge the completed stack on the discharge device.

Advantageously, the displacement device can be, then, arranged to move the discharge device to move the same from the predetermined second height q2 to the predetermined third height (q3) at which the discharge device is arranged to discharge the completed stack from the machine.

In an alternative embodiment foreseen by the invention, the displacement device can be configured to position the discharge device at the predetermined second height (q2) before starting a working cycle, i.e. before forming the aforementioned stack of folded or interfolded sheets. In this case, the discharge device can be, advantageously, arranged to remain at the predetermined second height (q2) during a working cycle at which is arranged to discharge the completed stack 50*a* from the machine.

Advantageously, the displacement device can comprise at least a transmission belt operated by a motor group to move along a vertical direction parallel to said forming direction.

In particular, the discharge device can be configured to move along a discharge direction in such a way to cause the completed stack to move away from the vertical forming direction.

Advantageously, the transfer group can comprise a first and a second support member configured to move from opposite sides with respect to the vertical forming direction between a position external to the stack being formed 1 and a respective support position, where are arranged to support respective portions of the stack being formed from opposite sides with respect to the vertical forming direction.

Advantageously, the first and second support members can be configured to move independently from each other along a vertical direction and along a horizontal direction.

In particular, the first support member, before that the second support member is arranged to be positioned at said respective support position, can be configured to move along a direction transversal to the completed stack up to exceed the respective support position, in such a way to stretch at least a portion of the stack being formed protruding from the first and second separators, said first support member being, then, adapted to withdraw up to be positioned at the respective support position. More in particular, the second support member can be arranged to be positioned in the respective support position of the stack after that the first support member has stretched the, or each, portion of the stack being formed to support together with the first support member the stack being formed.

Preferably, a detaching group is, furthermore, provided comprising a first plurality of detaching members, and a second plurality of detaching members, configured to act, respectively, at said first and at said second folding or interfolding roll, to detach said sheets from the external lateral surface of the respective folding or interfolding roll.

According to another aspect of the invention, a method for producing packages of folded or interfolded laminar products made of paper, in particular packages of napkins, tissues, towels, or similar products, comprises the steps of:

folding or interfolding by a folding or interfolding group, which is equipped with a first and a second folding or interfolding roll, a plurality of sheets in order to form a stack of folded or interfolded sheets according to a predetermined folding or interfolding configuration arranged to grow in height along a vertical forming direction;

separating a completed stack of folded or interfolded sheets once that a predetermined height of said stack being formed is reached, from a following stack being formed positioned upstream of said completed stack along said vertical forming direction, said separating step being carried out by a first and a second separator member arranged to enter into said stack being formed from opposite sides to separate said completed stack from said following stack being formed, said first and second separator members being arranged to support together said stack being formed;

transferring by a transfer group said completed stack on a discharge device configured to discharge said completed stack from said machine;

discharge said completed stack from said machine by a discharge device;

whose main characteristic is that a moving step is provided carried out by a displacement device for moving the discharge device along a displacement direction towards/from the transfer group.

BRIEF DESCRIPTION OF THE DRAWINGS

The invention will now be shown with the following description of its exemplary embodiments, exemplifying but not limitative, with reference to the attached drawings in which.

Figures from 1 to 9B diagrammatically show a front view of some possible steps carried out by a first embodiment of a machine, according to the invention, for producing packages of laminar products made of paper, in particular packages of napkins.

DETAILED DESCRIPTION OF SOME EXEMPLARY EMBODIMENTS OF THE INVENTION

Figure 1:
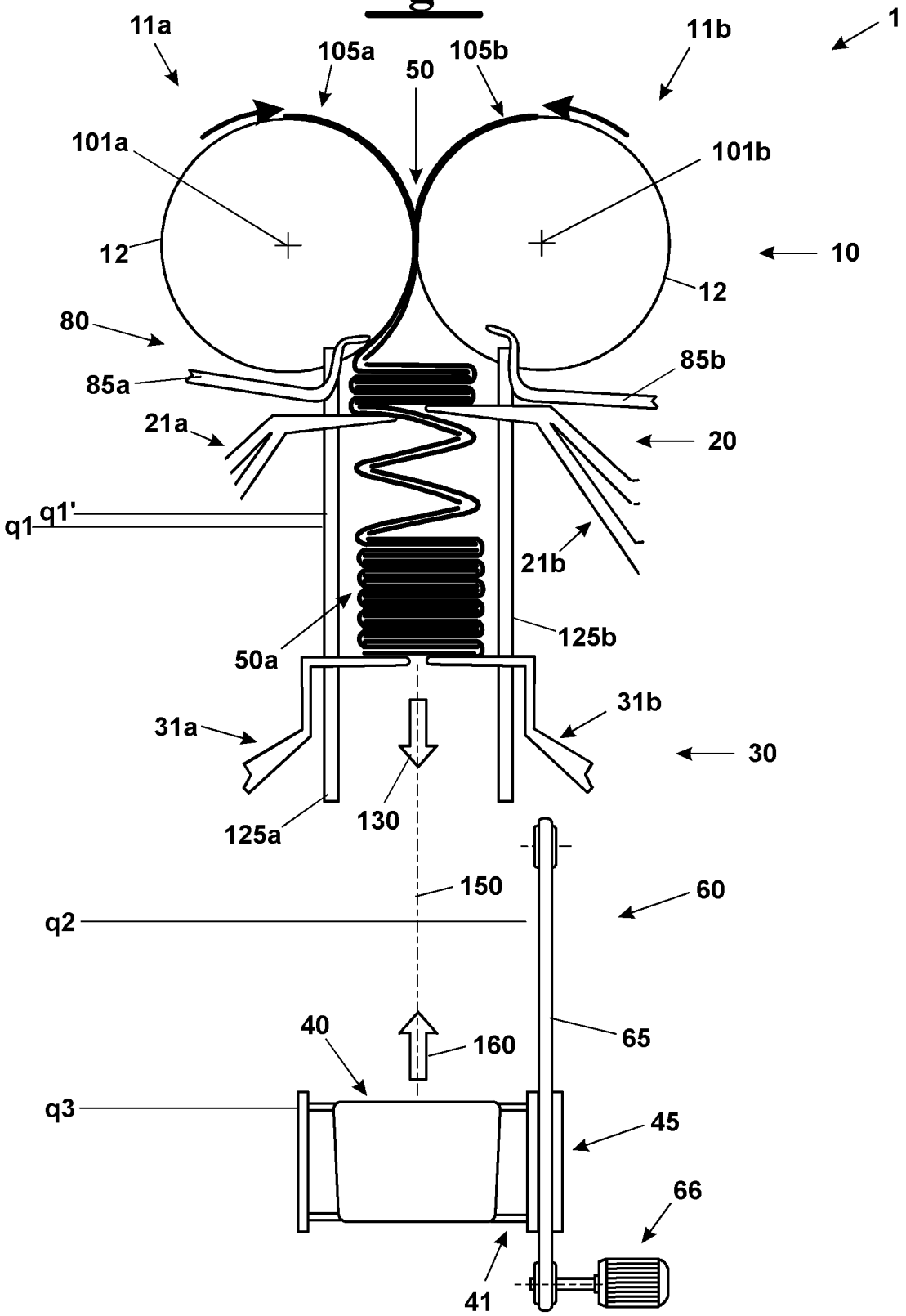
Figure 2:
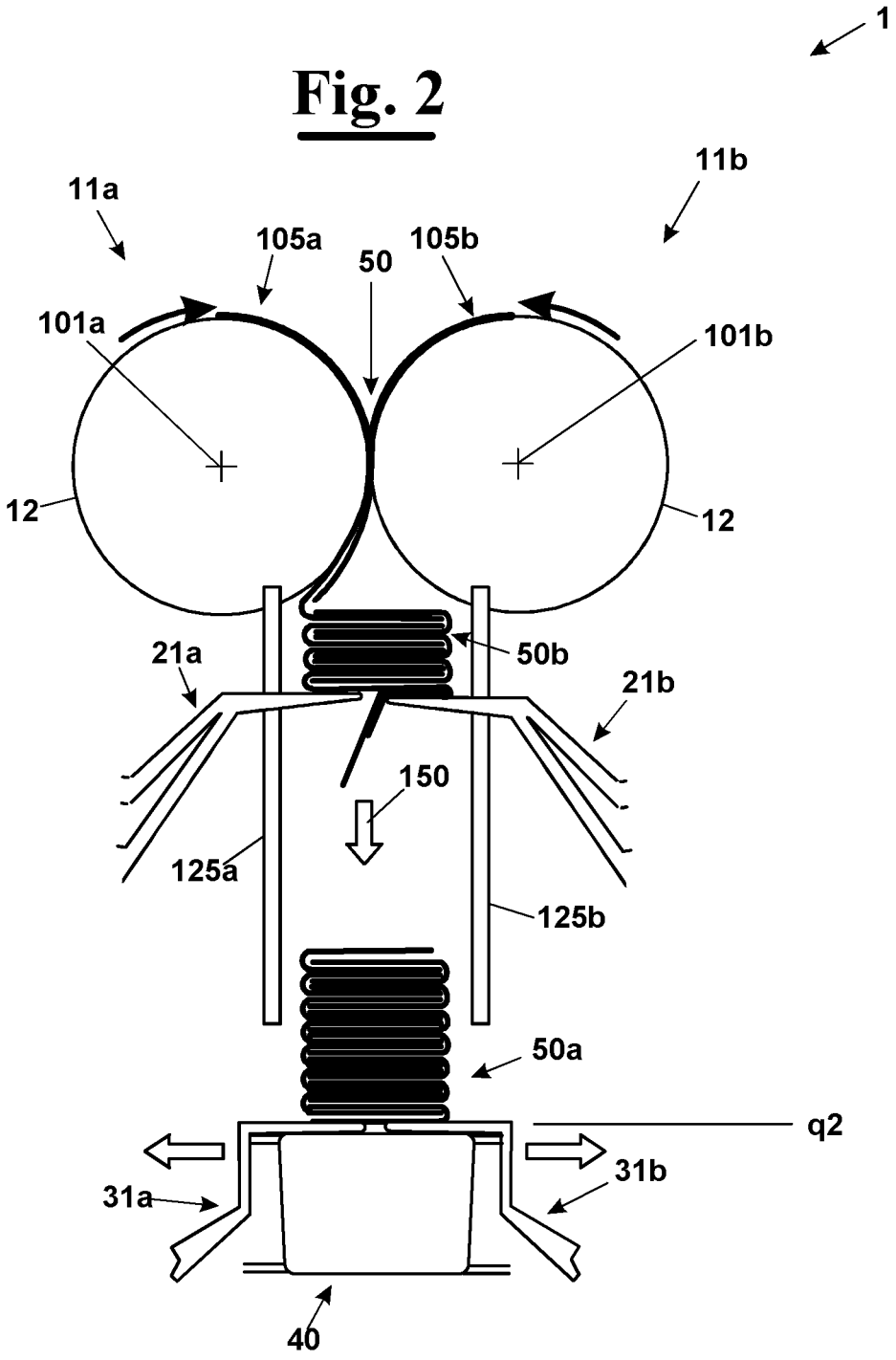
Figure 3:
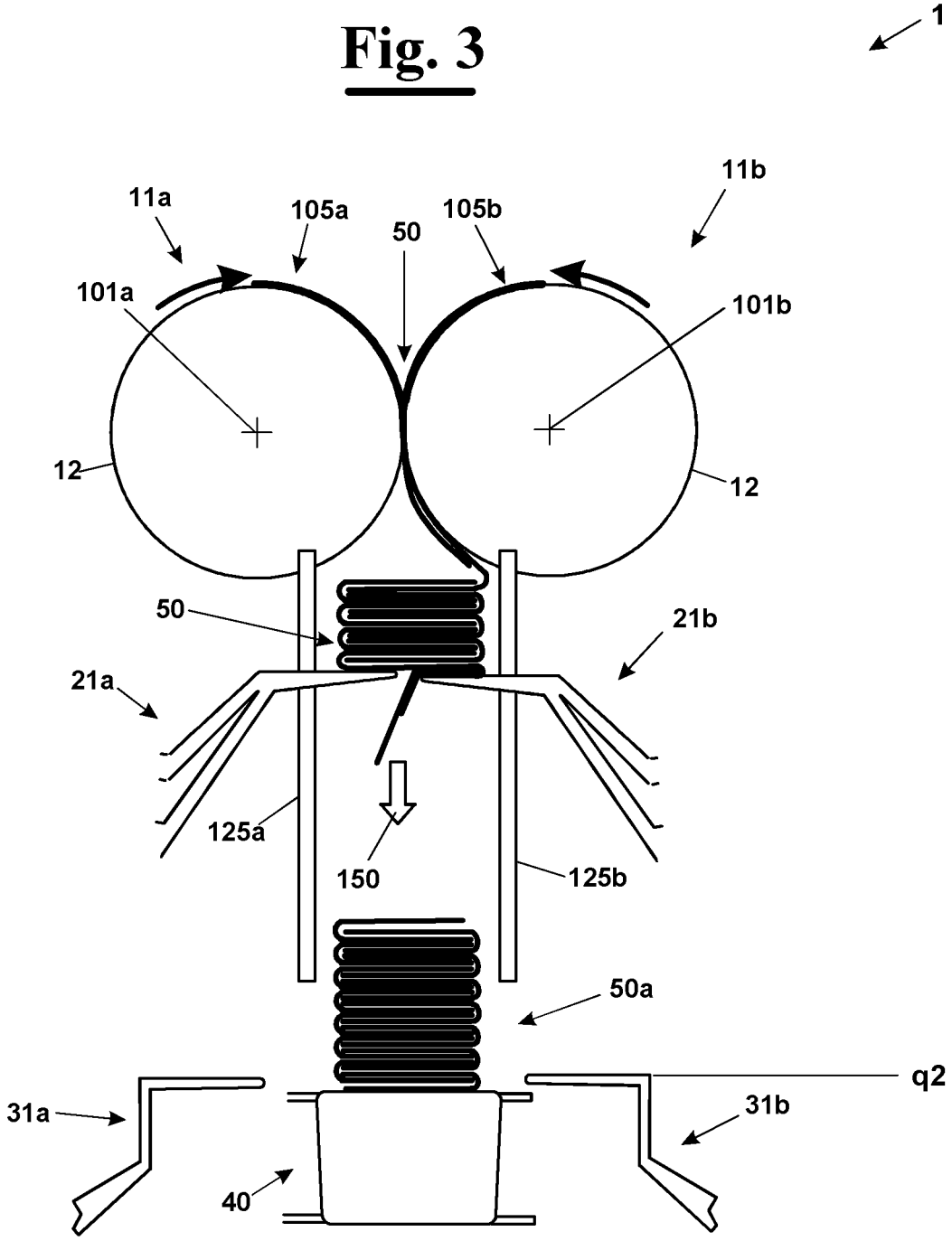
Figure 4:
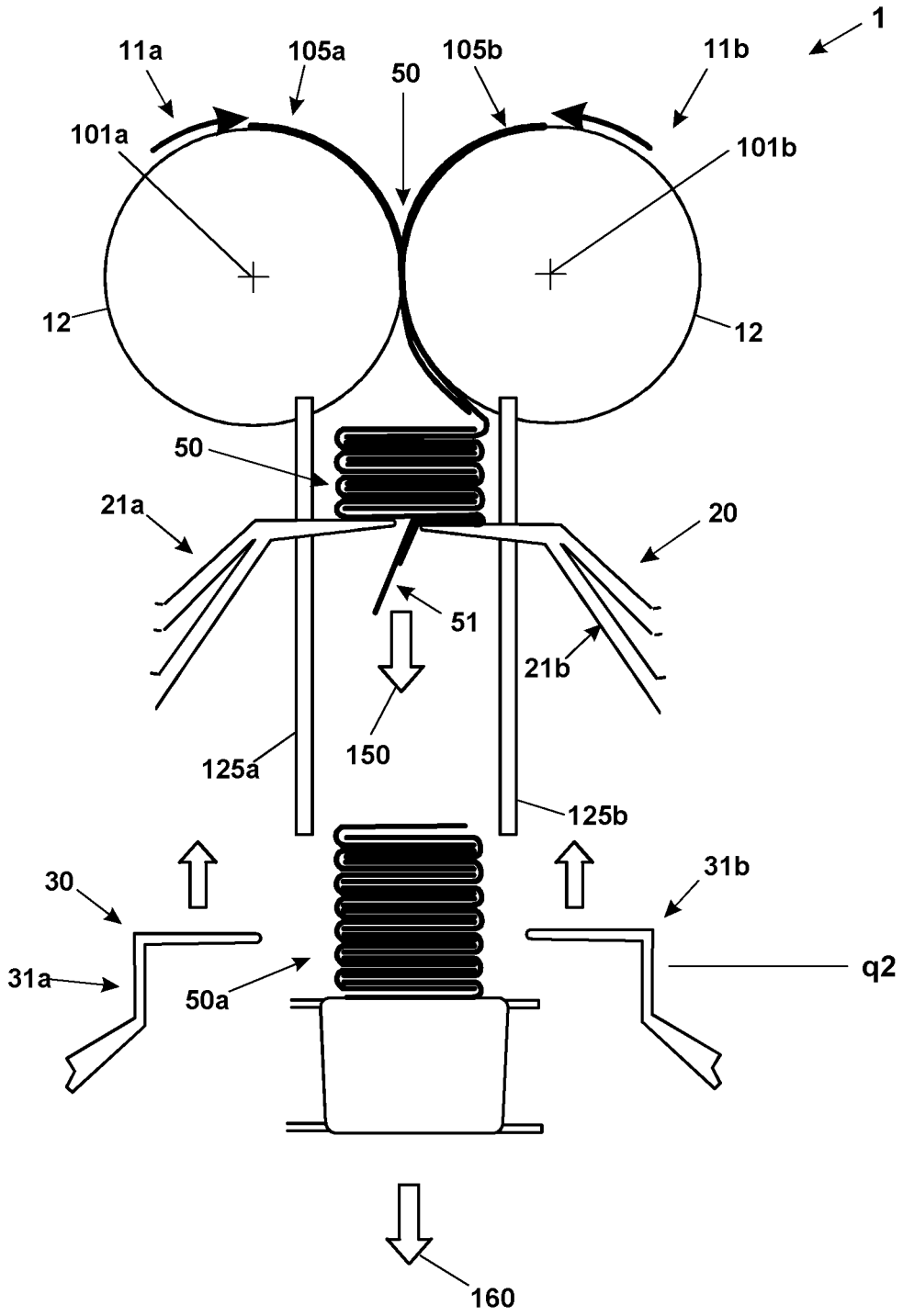

With reference to the FIGS. from 1 to 9B, a machine for producing packages of folded or interfolded laminar products made of paper, in particular packages of napkins, tissues, towels, or similar products, comprises a folding or interfolding group 10 equipped with a first and a second folding or interfolding roll 11*a* and 11*b* configured to fold or interfold a plurality of sheets of paper and to form a stack 50 of folded or interfolded sheets according to a predetermined folding or interfolding configuration. The stack 50 grows in height along a forming direction 150, in particular a vertical forming direction, up to obtain a completed stack 50*a* having a predetermined height H, or a predetermined number of sheets. More in detail, when the stack being formed 50 reaches the aforementioned height H, a separation group 20 divides the completed stack 50*a* of folded or interfolded sheets, so obtained, from a following stack being formed 50 positioned upstream of the completed stack 50*a* along the forming direction 150. In particular, the separation group 20 can comprise a first and a second separator member 21*a* and 21*b* arranged to enter into the stack being formed 50 from opposite sides to separate, as anticipated above, the completed stack 50*a* from the following stack being formed 50. In particular, the first and second separator members 21*a* and 21*b* can be configured to support together the completed stack 50*a*. More in particular, the first and second separator members 21*a* and 21*b* are configured to support together the completed stack 50*a* up to a predetermined first height q1 (see FIGS. 9A and 9B). The first and second separator members 21*a* and 21*b*, once they exit the stack 50*a* supported by the transfer group 30, are arranged to separate the stack 50*a* now completed from the following stack being formed 50 entering the same from opposite sides as described above to go on with the working cycle.

A transfer group 30 is, furthermore, provided configured to transfer the completed stack 50*a* on a discharge device 40, for example of movable type, such as a conveyor belt, or a chute, advantageously arranged to discharge the completed stack 50*a* from the machine. More in detail, the transfer group 30 is arranged to move the stack being formed 50 and, therefore, the completed stack 50*a* along a transfer direction 130, which, advantageously, coincides with the aforementioned vertical forming direction 150.

In particular, as diagrammatically shown as an example in the alternative embodiment that is shown in FIGS. 5 to 8, the transfer group 30 is arranged to be positioned from a position external to the stack being formed 50 to a support position at which is arranged to support the stack being formed 50 same together to the separation group 20. More precisely, the transfer group 30 is arranged to move from the position external to the support position, advantageously at a height q1' slightly higher than the first height q1 (see FIGS. 9A and 9B), at which the separation group 20 is arranged to exit the stack 50*a* being formed. Therefore, for a short stretch comprised between the height q1' and the first height q1 (FIG. 9B), the separation group 20 and the transfer group 30 support together the stack 50 being formed. The transfer group 30 is arranged to assist the growth in height of the stack being formed 50, in particular moving along the vertical direction at a determined speed, and, then, to transfer, accelerating, the completed stack 50*a* and discharging the same on the discharge device 40 at a second height q2, less than the first height q1, once that a predetermined height of the stack being formed 50 is reached. As a skilled person in the art will have no difficulty to understand, in the FIGS. 1 to 9B, the heights q1', q1, q2 and q3 are indicated approximately.

According to the present invention, a displacement device 60 is, furthermore, provided operatively connected to the aforementioned discharge device 40 and configured to move the discharge device 40 along a displacement direction 160 towards/from the transfer group 30. For example, the discharge device 40 can be engaged at least at a side 41 to the aforementioned displacement device 60, in particular by an engagement device 45.

In a first embodiment foreseen, the displacement device 60 can be configured to move the discharge device 40 along the aforementioned displacement direction 160 during a working cycle, i.e. during the motion of the transfer group 30 with the stack of sheets positioned on it. In particular, in this case, the displacement device 60 is arranged to move the discharge device 40 from a third height q3 less than the second height q2 up to the second height q2 at which the transfer group 30 is arranged to discharge the completed stack 50*a* on the discharge device 40. The displacement device 60 is, then, arranged to move the discharge device 40 in the direction opposite to the previous one to move it from the second height q2 to the third height q3 at which the discharge device 40 is arranged to discharge the completed stack 50*a* outside the machine. The sequence described above is, then, repeated for all the production cycle of the machine as described above.

In this way, it is possible to reduce the stroke of the transfer group 30 with respect to the prior art solutions obtaining a great energy conservation and is, thus furthermore, possible to increase the productivity of the machine and, therefore, to optimize the cycle of the machine for transferring and discharging the completed stack 50*a*.

Figure 14:
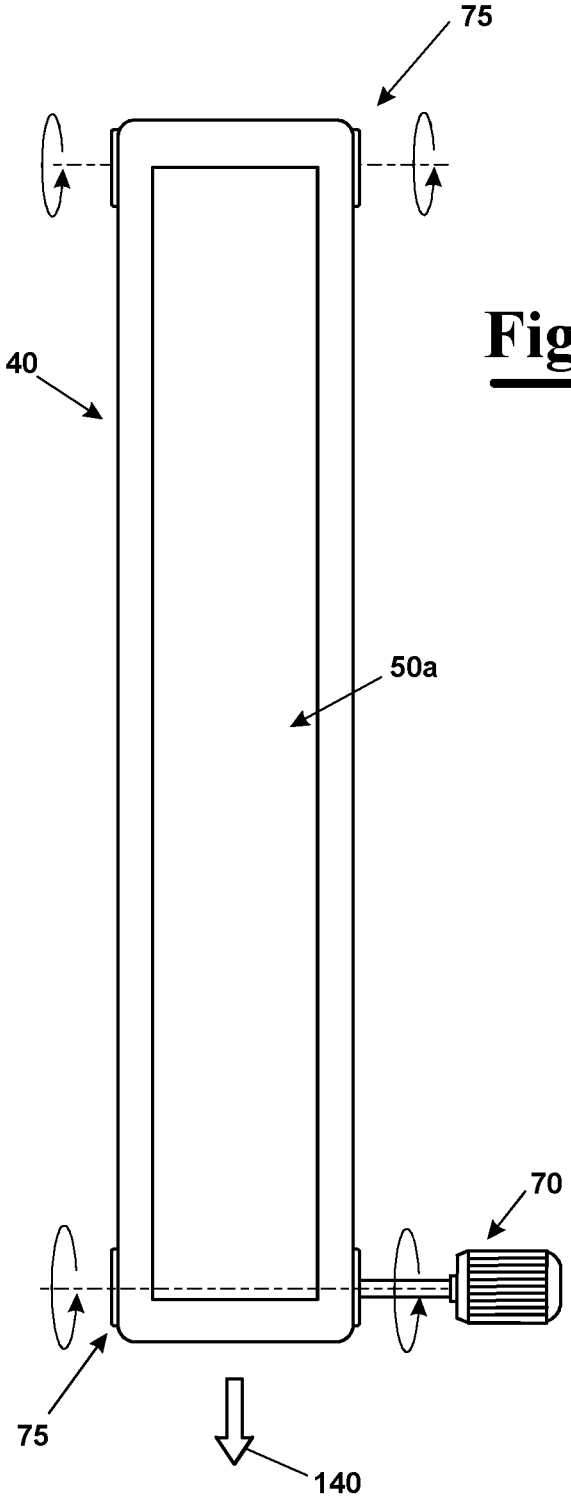
FIG. 14 diagrammatically shows a plan view of a possible embodiment of a discharge device of packages of products obtained by one of the embodiments of the machine that are shown in the FIGS. 1 to 13.

As diagrammatically shown for example in FIG. 1, the displacement device 60 can comprise at least a transmission belt 65 operated by a motor group 66 to move along the displacement direction 160 towards the, or from the transfer group 30. The displacement device 60 can comprise at least one actuator, of hydraulic, electric, or pneumatic type, or a motor coupled to a motion transmission device for example a rack and pinion, or other devices able to cause a movement of the discharge device 40 towards/from the transfer group 30. In particular, as diagrammatically shown in FIG. 14, the discharge device 40 is configured to cause the completed stack 50*a* to move along a discharge direction 140, in particular orthogonal to the displacement direction 160, to cause the completed stack 50*a* to move away from the forming direction 150. For example, the discharge device 40 can be a conveyor belt operated by a motor.

Figure 5:
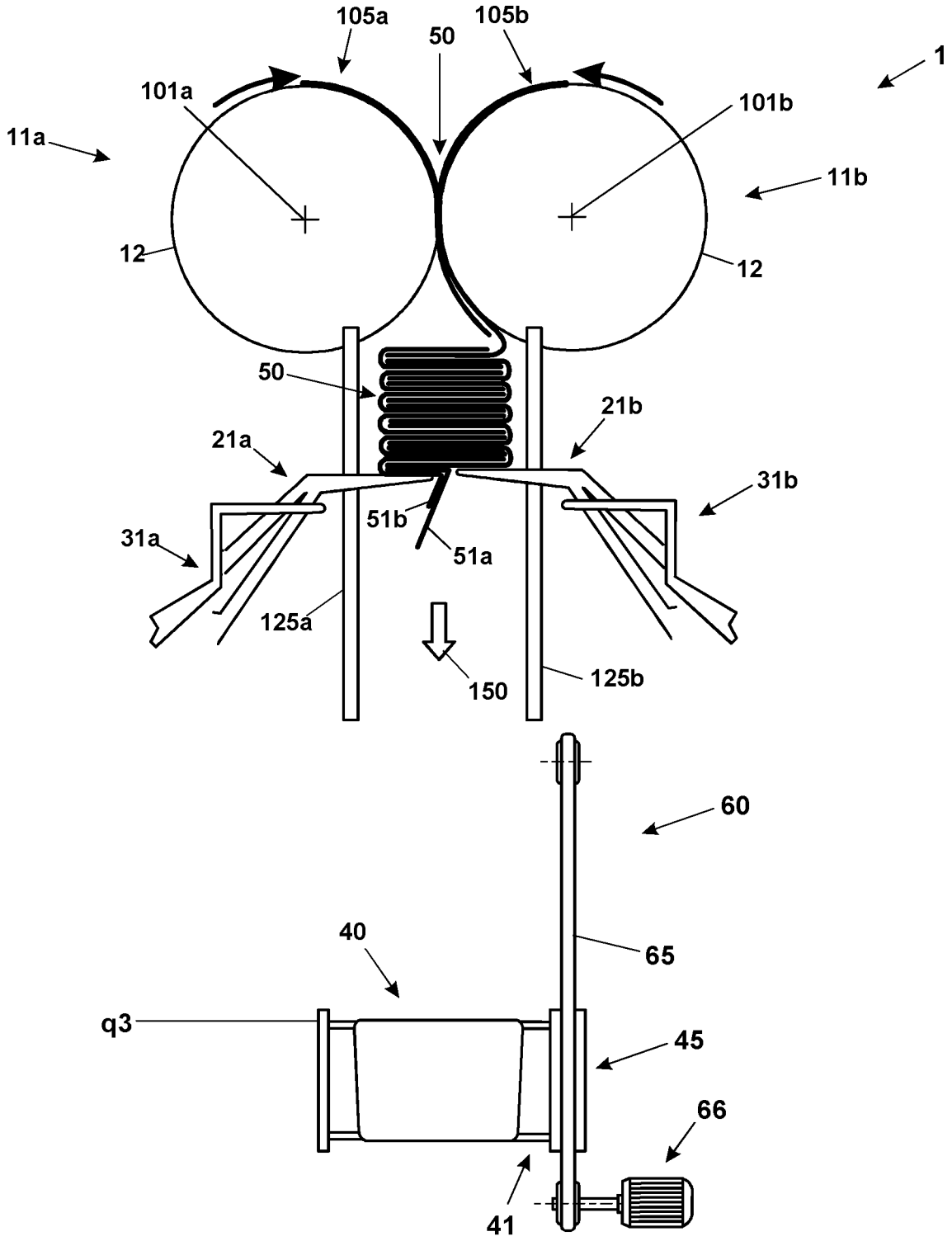
Figure 6:
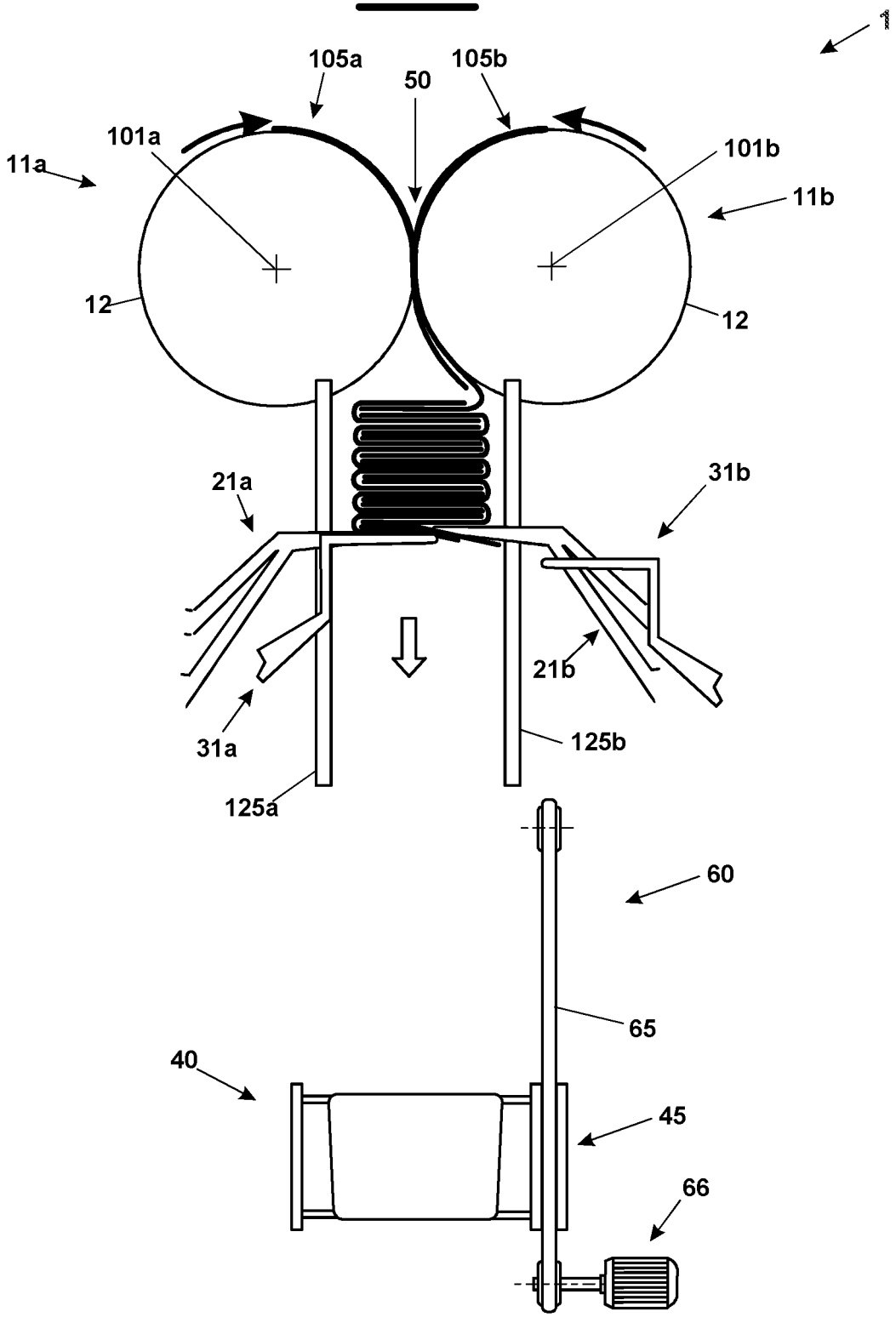

As diagrammatically shown in the example of FIGS. 1 to 9B, the transfer group 30 can, for example comprise a first and a second support member 31*a* and 31*b* configured to move from opposite sides with respect to the vertical forming direction 150 between a position external to the stack being formed 50 (see for example FIGS. 3, 4 and 5) and a respective support position (see FIGS. 1 and 9A), where they are arranged to support respective portions of the stack being formed 50 from opposite sides with respect to the vertical forming direction 150. Advantageously, the first and second support members 31*a* and 31*b* are configured to move independently from each other along a vertical direction and along a horizontal direction. In this way, it is possible to carry out the operations described in the following, as an example, with reference to the FIGS. 5 to 9B. In particular, the first support member 31*a*, before that the second support member 31*b* is positioned at the respective support position, can be configured to move along a direction transversal to the stack being formed 50, in particular below the separation group 20, exceeding the respective support position, advantageously running substantially all the width of the stack being formed 50, to stretch at least a portion 51, for example a first and a second portion 51*a* and 51*b*, of the stack being formed 50 protruding from the first and second separators 21*a* and 21*b* (FIGS. 5 and 6). The first support member 31*a* can be, then, arranged to withdraw up to be positioned at the respective support position to support the stack being formed together with the second support member 31*b*.

Figure 7:
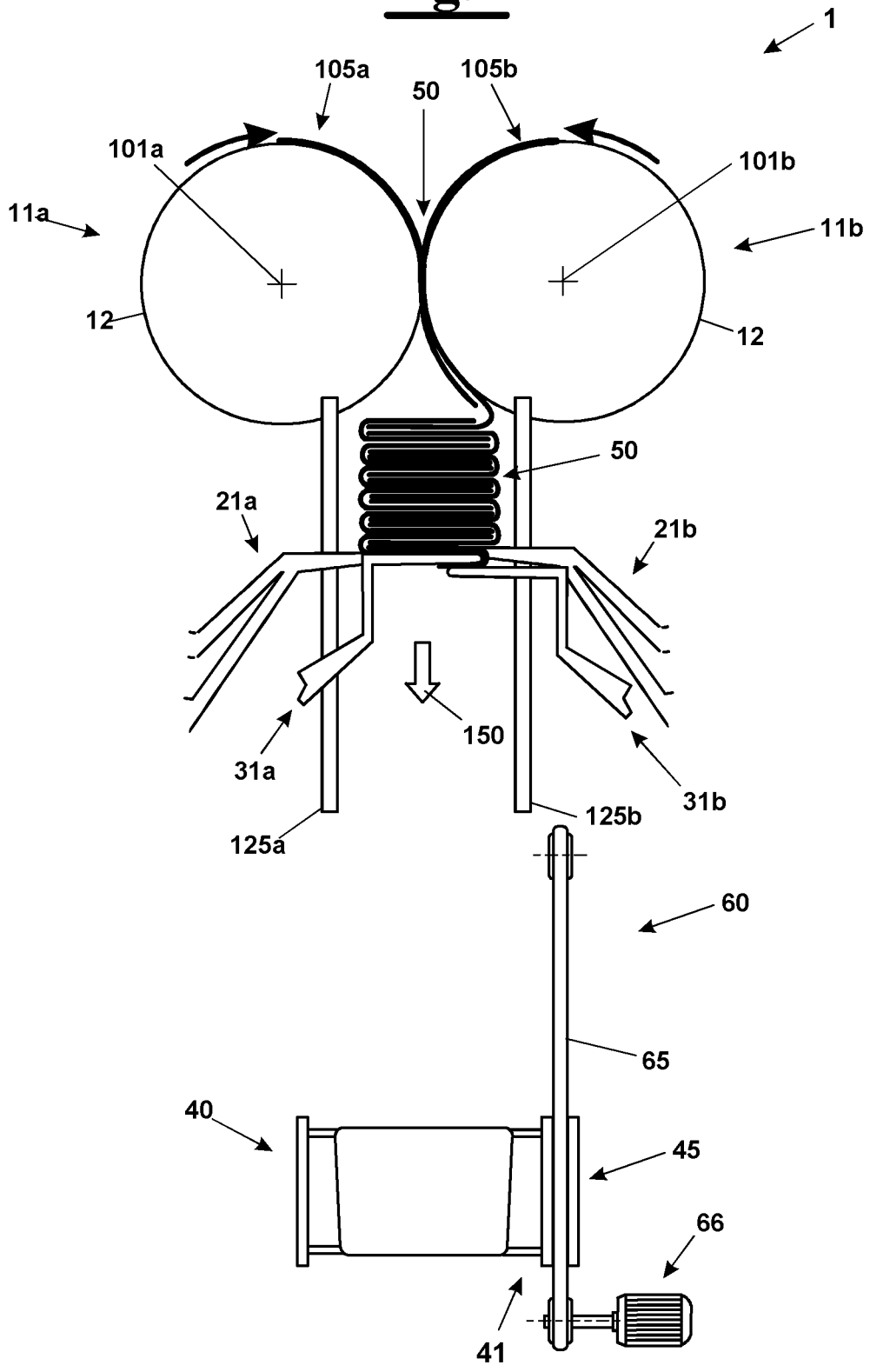
Figure 8:
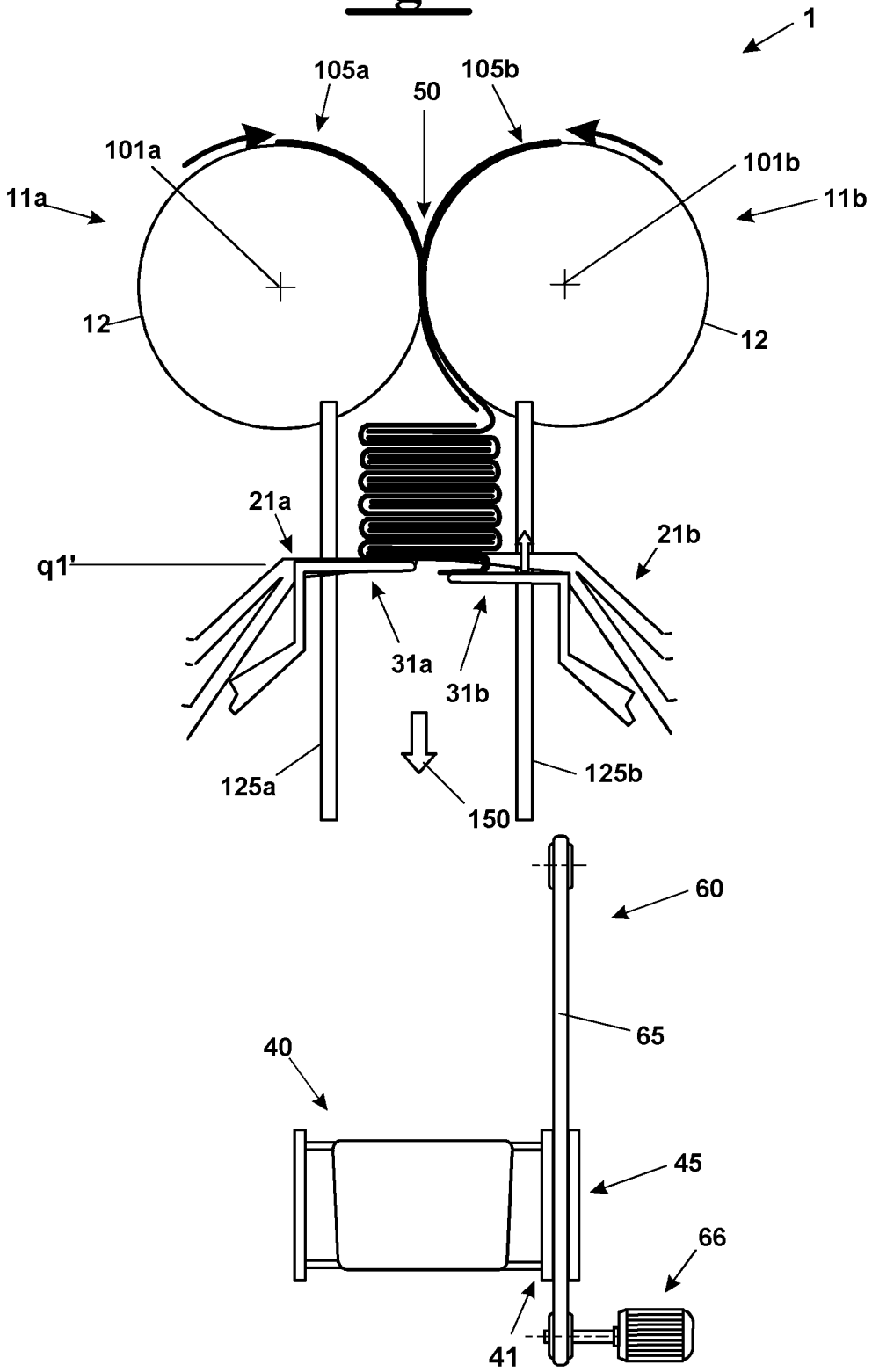
Figure 9A:
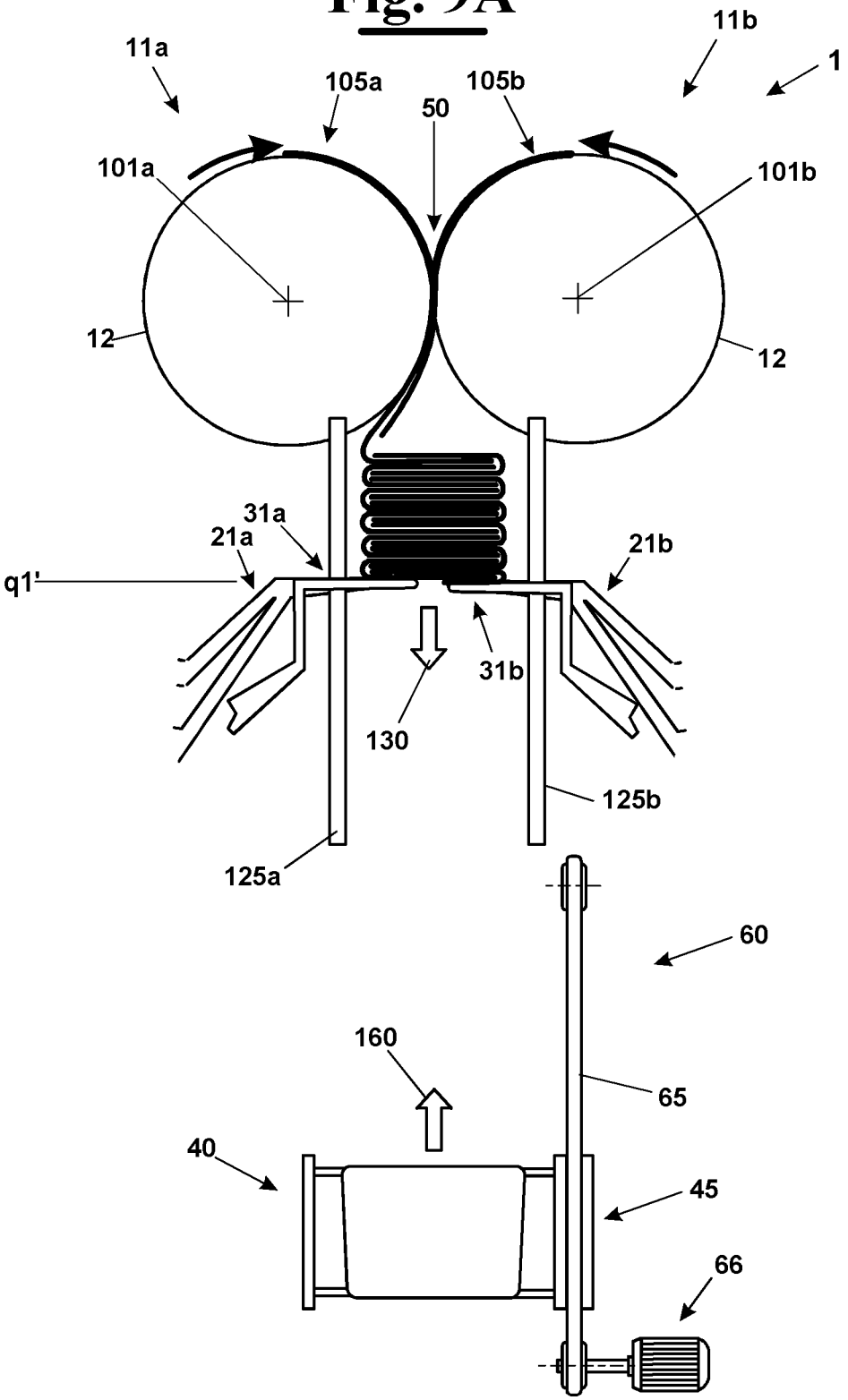
Figure 9B:
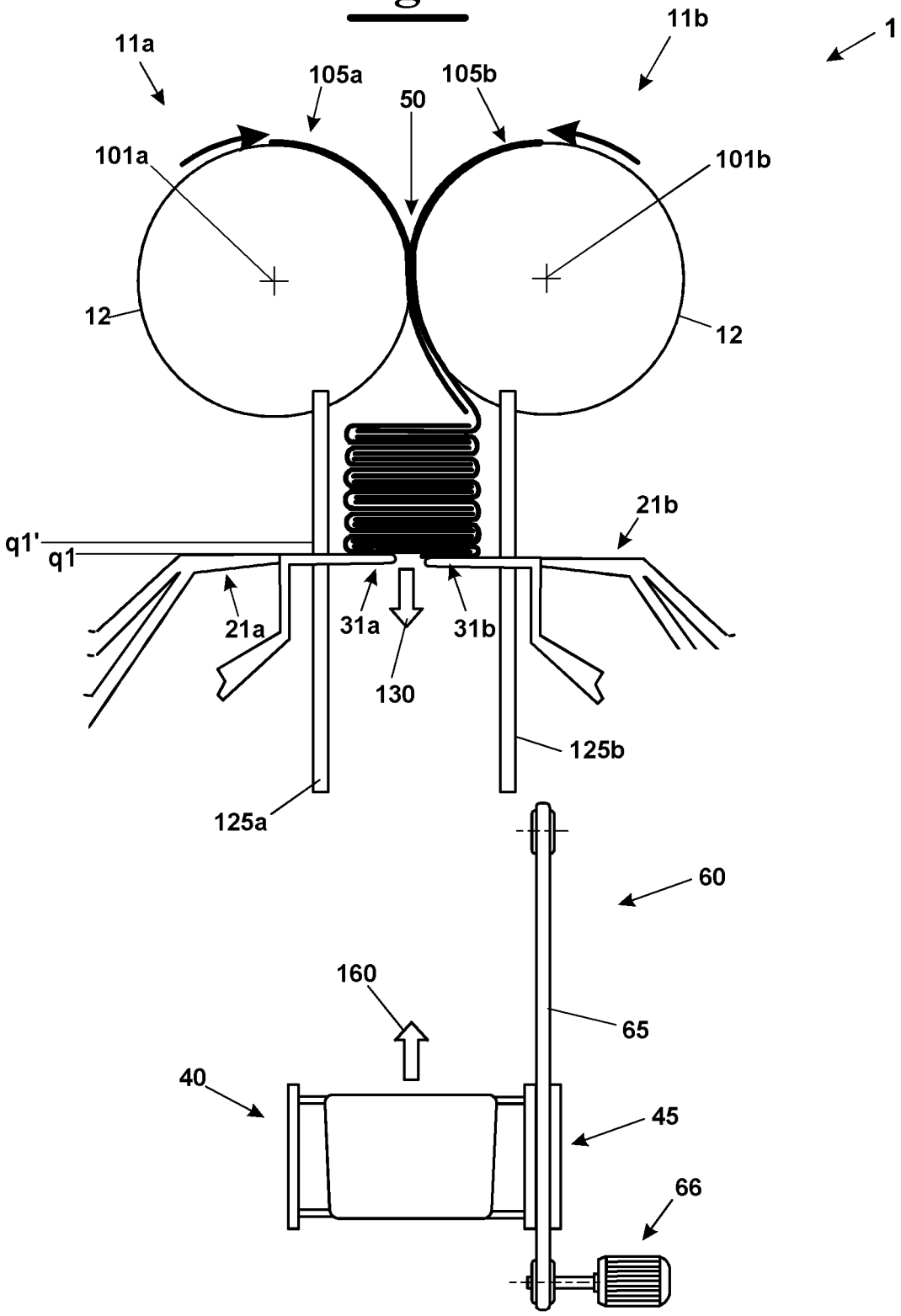

Advantageously, before that the first support member 31*a* is arranged to withdraw to be positioned in the respective support position, the second support member 31*b* can be arranged to be positioned below the first support member 31*a* to press a portion of the, or each, portion 51 protruding from the first support member 31*a* (FIG. 7). Then, the first support member 31*a* is arranged to withdraw to be positioned in the respective support position and the second support member 31*b* is arranged to be positioned at the same, or substantially the same, height of the first support member 31*a* to support together the stack being formed 50 (FIGS. 8 and 9A).

The inlet movement of the first support member 31*a* to be positioned at the support position for supporting the stack being formed, comprising also the movement for stretching at least the portion 51, and the inlet movement of the second support member 31*b* to support the stack being formed together with the first support member 31*a* is, advantageously, about comprised between the height q1' and the height q1 (see the sequence shown from FIG. 6 to FIG. 9A).

As diagrammatically shown only in FIG. 1 for clarity reasons, a detaching group 80 is, furthermore, advantageously, provided comprising a first plurality of detaching members 85*a*, or "detaching fingers", and a second plurality of detaching members 85*b*, or "detaching fingers" configured to act, respectively, at the first and the second folding or interfolding rolls 11*a* and 11*b* to detach the sheets 105 from the external lateral surface 12 of the respective folding or interfolding roll, 11*a*, or 11*b*.

Figure 10:
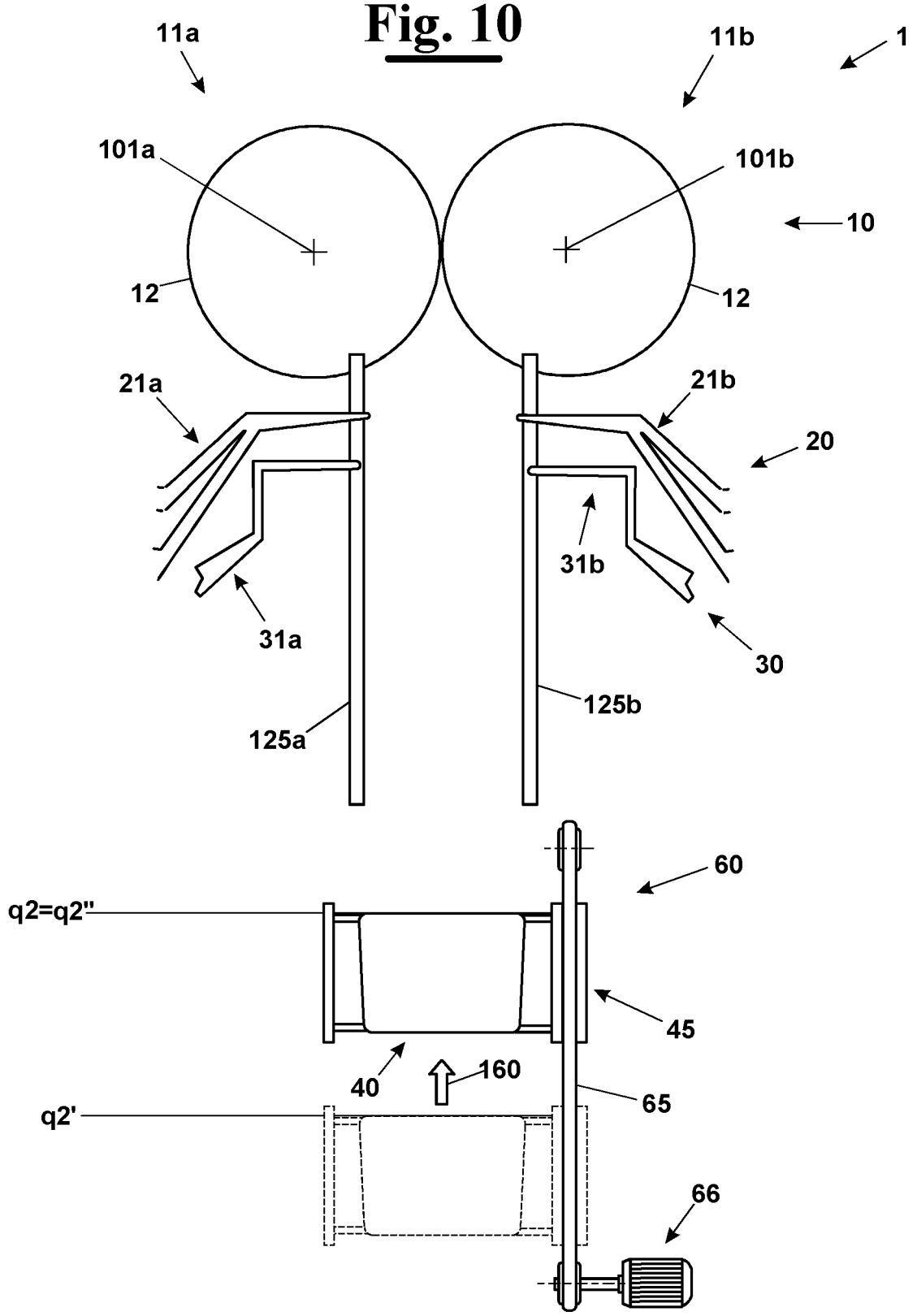
FIGS. 10 and 11 diagrammatically show a front view of a possible alternative embodiment of the machine of FIG. 1.
Figure 11:
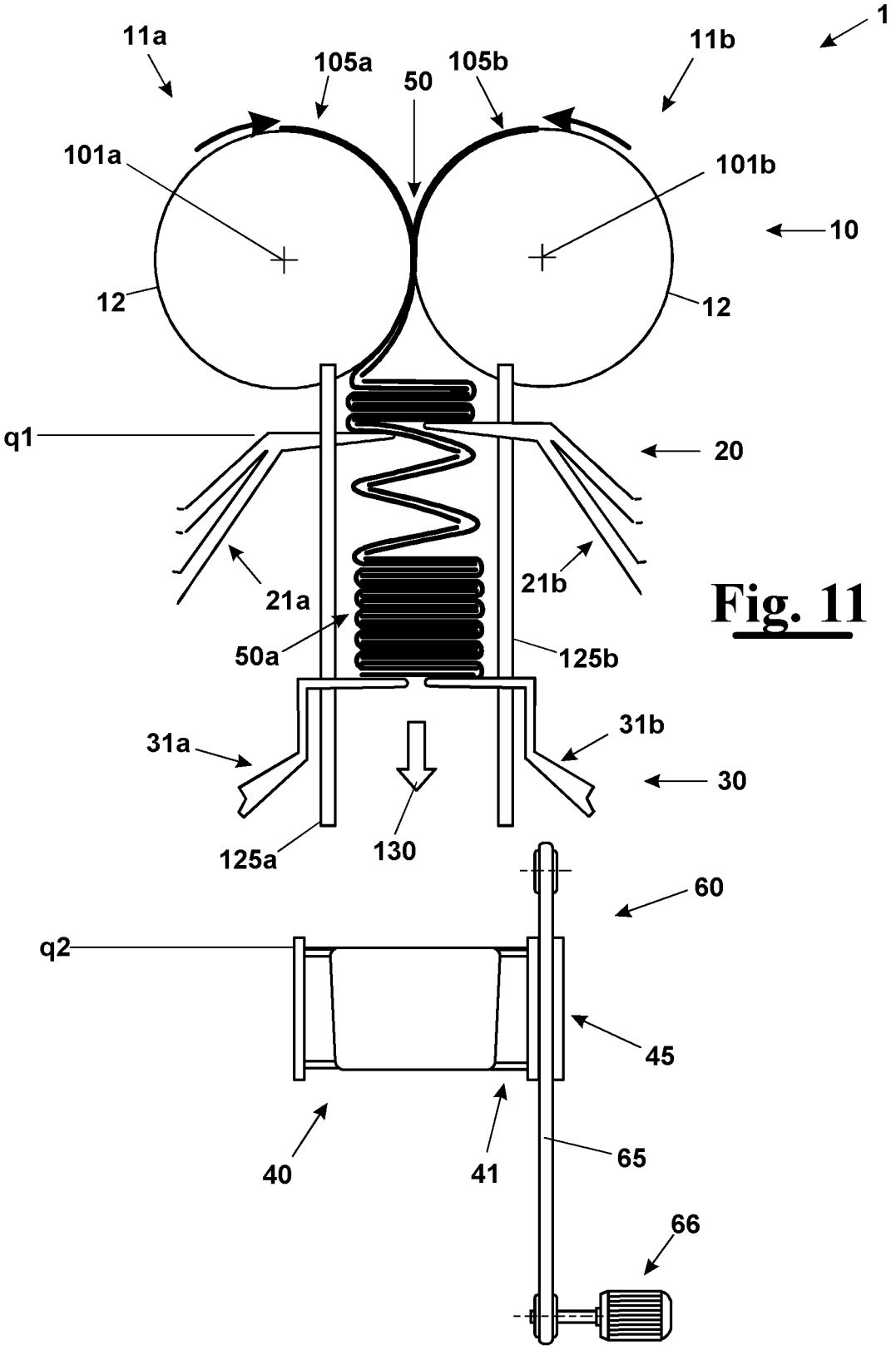

As diagrammatically shown in the FIGS. 10 and 11, the displacement device 60 can be configured to position the discharge device 40 at the second height q2 before starting a production cycle. In particular, the second height q2 can be selected from a plurality of suitable second heights q2, for example at least a first height q2' and a second height q2". For example, the height q2' can be computed according to the type of product to be produced, that means according to the number of sheets of which the completed stack 50*a* is formed, and, in general, according to the height of the completed stack 50*a*. In this case, during a working cycle, the discharge device 40 can be arranged to remain at the second height q2 at which is arranged to discharge the completed stack 50*a* thus causing a movement of the same along the aforementioned discharge direction 140. The other steps of the process are substantially the same described above with reference to the previous case (FIGS. 1 to 9B) with the difference that during a working cycle, the discharge device 40 stays at the aforementioned height q2 once that has been set.

This solution allows, in particular, to modify the machine equipped with the folding or interfolding unit described above to produce products of different size, in particular packages of folded or interfolded sheets of paper having different heights and, therefore, makes the machine highly flexible.

Figure 12:
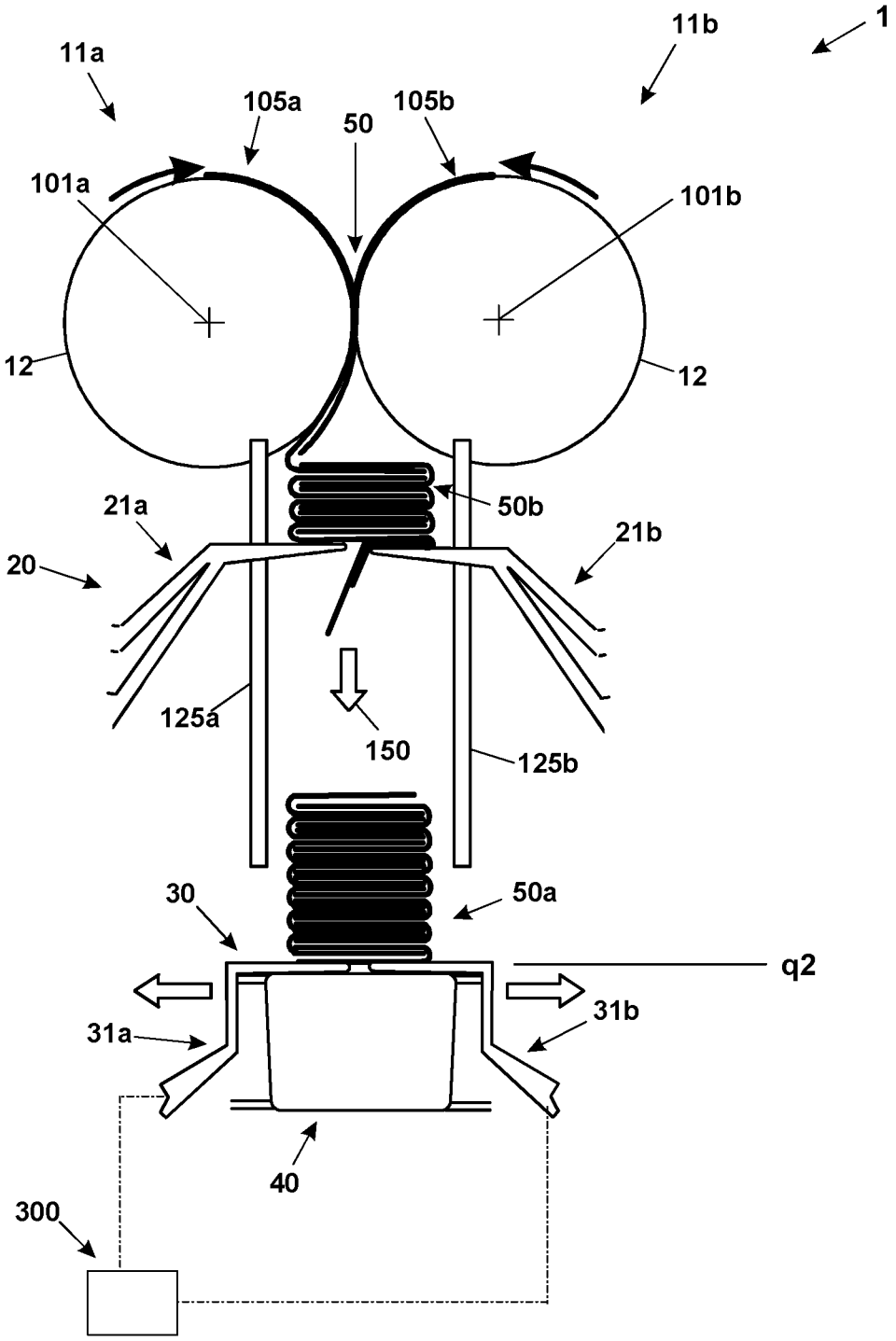
FIGS. 12 and 13 diagrammatically show a front view of other possible alternative embodiments of the machine of FIG. 1 foreseen by the invention.
Figure 13:
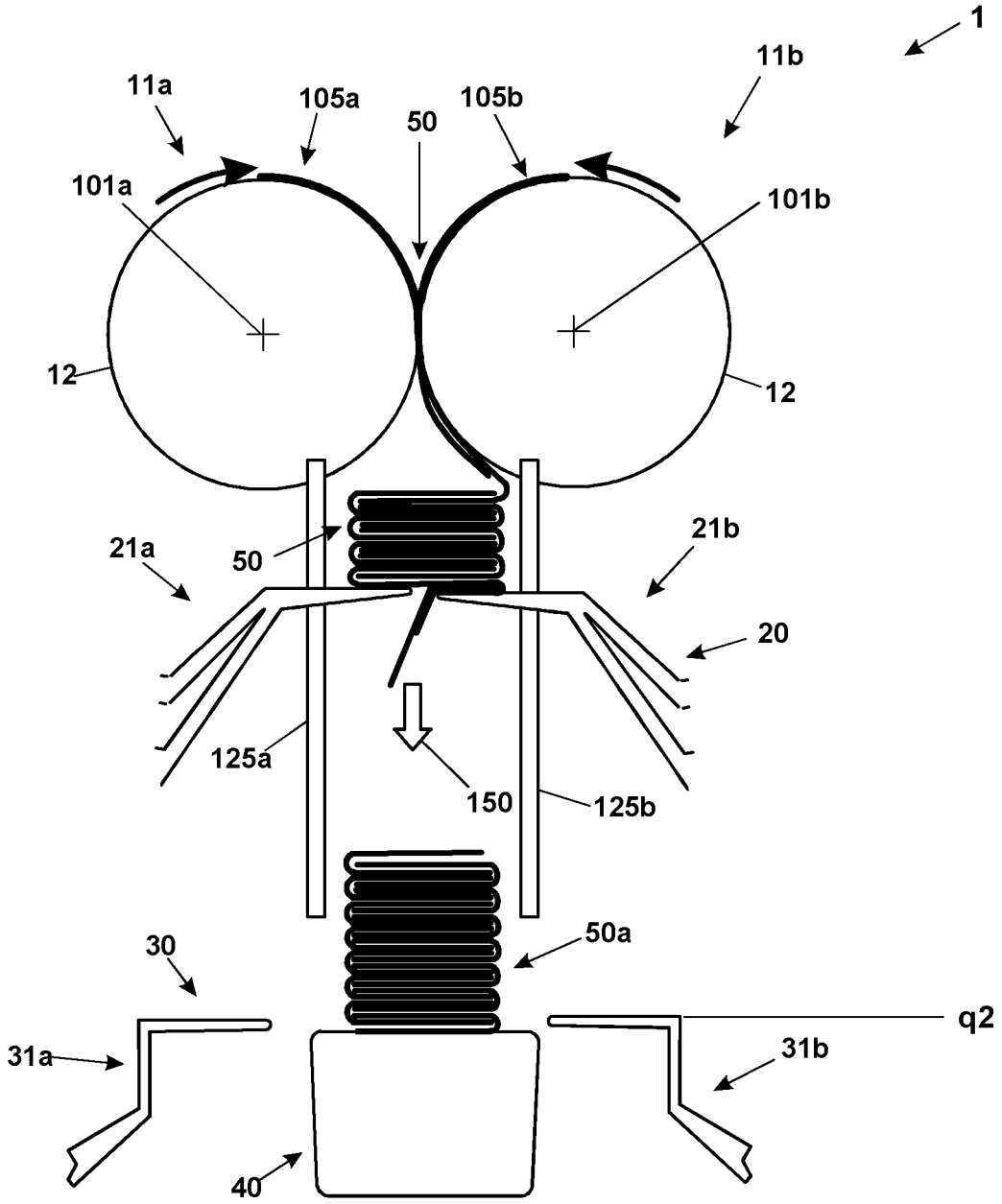

In particular, a control group 300 can be provided as diagrammatically shown in FIG. 12, configured to adjust and control the stroke of the transfer group 30, in particular to set the height q2 at which is arranged to discharge the completed stack 50*a* on the discharge device 40. More in particular, the height q2 at which the end of the stroke of the transfer group 30 is set, corresponds to the height q2 at which the discharge device 40 is positioned in the preliminary step. The adjustment group 300 can comprise a computer, a PLC or any other electronic device that is able to compute the height q1 and/or the height q2 and/or the height q3 and/or the height q1' and/or the height q2' according to the type of product, and more in particular according to the height of the product. In practice, the control group 300 computes the height of the product according to the folding configuration of the sheets, for example "L", "V", "M", "W", and to the number of the sheets forming a completed stack that an operator can set or select by a graphic interface or by a remote connection. The control group 300 for computing the height of the completed stack can also use, as further data, the paper weight. In this way, the heights q1, q2 and q3 are computed in an optimized way to reduce the strokes of the separation group 20, of the transfer group 30 and, if foreseen, of the type of machine cycle, of the discharge device 40.

In a further embodiment according to the invention that is not shown in the figures for simplicity, the possibility is also provided that the displacement device 60 is associated to a supplementary adjustment device that is not shown in the figure for simplicity, configured to set the height q2 of the discharge device 40 and to move, then, during a working cycle, the discharge device 40 towards and from the transfer group 30 between the height q2 so set by the aforementioned supplementary adjustment device and the height q3 at which the discharge device 40 is arranged to discharge the completed stack 50*a* of the machine, analogously to what described above with reference to the FIGS. 1 to 9B.

The foregoing description exemplary embodiments of the invention will so fully reveal the invention according to the conceptual point of view, so that others, by applying current knowledge, will be able to modify and/or adapt for such embodiment without further various applications research and without parting from the invention, and, accordingly, it is therefore to be understood that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. A machine for producing packages of folded or interfolded laminar products made of paper, in particular packages of napkins, tissues, towels, or similar products, said machine comprising:

a folding or interfolding group equipped with a first and a second folding or interfolding roll configured to fold or interfold a plurality of sheets of paper, and to obtain a stack of folded or interfolded sheets according to a predetermined folding or interfolding configuration arranged to grow in height along a vertical forming direction;

a separation group configured to separate a completed stack of folded or interfolded sheets, once that a predetermined height of said stack being formed is reached, from a following stack being formed positioned upstream of said completed stack along said vertical forming direction, said separation group comprising a first and a second separator member arranged to enter into said stack being formed from opposite sides to separate said completed stack from said following stack being formed;

a transfer group configured to transfer said completed stack on a discharge device configured to discharge said completed stack from said machine; and a displacement device operatively connected to said discharge device and configured to move said discharge device along a displacement direction towards/from said transfer group.

2. The machine according to claim 1, wherein said first separator member and said second separator member are arranged to support together said completed stack up to a predetermined first height (q1).

3. The machine according to claim 2, wherein said transfer group is arranged to move from a position external to said stack and a support position at a height (q1') higher than said first height (q1) whereby said separation group and said transfer group are arranged to support together said stack being formed between said height (q1') and said first height (q1).

4. The machine according to claim 3, wherein said transfer group is arranged to support said stack being formed between said first height (q1) and a second height (q2), with said second height (q2) less than said first height (q1).

5. The machine according to claim 2, wherein said transfer group is arranged to support said stack being formed between said first height (q1) and a second height (q2), with said second height (q2) less than said first height (q1).

6. The machine according to claim 5, wherein at said second height (q2) said transfer group is arranged to position said completed stack on said discharge device.

7. The machine according to claim 6, wherein said displacement device is configured to move said discharge device along said displacement direction, during said transfer group is moved from a predetermined third height (q3) less than said predetermined second height (q2) up to said predetermined second height (q2) at which said transfer group is arranged to discharge said completed stack on said discharge device and wherein said displacement device is, then, arranged to move said discharge device to move the same from said predetermined second height (q2) to said predetermined third height at which said discharge device is arranged to discharge said completed stack from the machine.

8. The machine according to claim 6, wherein said displacement device is configured to position said discharge device at said predetermined second height (q2) before starting a working cycle, i.e. before said transfer group starts to move with said stack positioned on the same, said discharge device being arranged to remain at said predetermined second height (q2) during a working cycle at which is arranged to discharge said completed stack.

9. The machine according to claim 5, wherein said displacement device is configured to move said discharge device along said displacement direction, during said transfer group is moved from a predetermined third height (q3) less than said predetermined second height (q2) up to said predetermined second height (q2) at which said transfer group is arranged to discharge said completed stack on said discharge device and wherein said displacement device is, then, arranged to move said discharge device to move the same from said predetermined second height (q2) to said predetermined third height (q3) at which said discharge device is arranged to discharge said completed stack from the machine.

10. The machine according to claim 5, wherein said displacement device is configured to position said discharge device at said predetermined second height (q2) before starting a working cycle, i.e. before said transfer group starts to move with said stack positioned on the same, said discharge device being arranged to remain at said predetermined second height (q2) during a working cycle at which is arranged to discharge said completed stack.

11. The machine according to claim 2, wherein a control group is, furthermore, provided configured to compute said first height (q1) and/or said second height (q2) and/or said third height (q3) according to the height, or the type of product to be produced.

12. The machine according to claim 1, wherein said displacement device comprises at least a transmission belt operated by a motor group to move along a vertical direction parallel to the aforementioned vertical forming direction.

13. The machine according to claim 1, wherein said discharge device is configured to move along a discharge direction to cause said completed stack to move away from said vertical forming direction.

14. The machine according to claim 1, wherein said transfer group comprises a first and a second support member configured to move from opposite sides with respect to said vertical forming direction between a position external to said stack being formed and a respective support position, where they are arranged to support respective portions of said stack being formed from opposite sides with respect to said vertical forming direction.

15. The machine according to claim 14, wherein said first and second support members are configured to move independently from each other along a vertical direction and along a horizontal direction.

16. The machine according to claim 15, wherein said first support member, before that said second support member is arranged to be positioned at said support position, is configured to move along a direction transversal to said stack being formed up to exceed said respective support position in such a way to stretch at least a portion of said stack being formed exiting said first and second separator members, said first support member being, then, arranged to withdraw up to be positioned at said respective support position to support said stack being formed together with said second support member.

17. The machine according to claim 14, wherein said first support member, before that said second support member is arranged to be positioned at said support position, is configured to move along a direction transversal to said stack being formed up to exceed said respective support position in such a way to stretch at least a portion of said stack being formed exiting said first and second separator members said first support member being, then, arranged to withdraw up to be positioned at said respective support position to support said stack being formed together with said second support member.

18. The machine according to claim 14, wherein said second support member is arranged to be positioned at said respective support position of said stack being formed after that said first support member has stretched said at least a portion of said stack being formed to support said stack being formed together with said first support member.

19. A method for producing packages of folded or interfolded laminar products made of paper, in particular packages of napkins, tissues, towels, or similar products, said method comprising the steps of:

folding or interfolding, by a folding or interfolding group, equipped with a first and a second folding or interfolding roll a plurality of sheets to form a stack of folded or interfolded sheets according to a predetermined folding or interfolding configuration arranged to grow in height along a vertical forming direction;

separating a completed stack of folded or interfolded sheets once that a predetermined height of said stack being formed is reached, from a following stack being formed positioned upstream of said completed stack along said vertical forming direction, said separating step being carried out by a first and a second separator member arranged to enter into said stack being formed from opposite sides to separate said completed stack from said following stack being formed, said first and second separator members being arranged to support together said stack being formed;

transferring by a transfer group said completed stack on a discharge device configured to discharge said completed stack from said machine;

discharging by a discharge device said completed stack from said machine; and moving by a displacement device said discharge device along a displacement direction towards/from said transfer group.

* * * * *